United States Patent [19]

Sweet

[11] 4,157,095

[45] Jun. 5, 1979

[54] REINFORCED ARTIFICIAL FINGERNAIL

[76] Inventor: Sandra S. Sweet, P.O. Box 2744, Rolling Hill Estates, Calif. 90274

[21] Appl. No.: 874,314

[22] Filed: Feb. 1, 1978

[51] Int. Cl.[2] ..... A45B 29/00

[52] U.S. Cl. ..... 132/73

[58] Field of Search ..... 132/73, 73.5, 79; 128/77, 132

[56] References Cited

U.S. PATENT DOCUMENTS

| | | | |
|---|---|---|---|
| 1,917,794 | 7/1933 | Brown | 128/77 |
| 1,978,144 | 10/1934 | Roberts | 132/73 |
| 2,031,225 | 2/1936 | O'Donnell | 132/73 |
| 2,764,168 | 9/1956 | Herz | 132/73 |
| 3,478,756 | 11/1969 | Sautter et al. | 132/73 |
| 3,487,831 | 1/1970 | Jaume et al. | 128/132 |

*Primary Examiner*—G. E. McNeill

*Attorney, Agent, or Firm*—Clarence A. O'Brien; Harvey B. Jacobson

[57] ABSTRACT

A method for forming a reinforced artificial fingernail in situ and the article formed thereby, the invention comprising the application of a layer of polymeric material is disclosed, preferably acrylic polymer, to a fingernail through a mask fitted onto the end of a finger, a reinforcing element such as a rigid pin or sheet formed of "glass" fiber or other similar material being then disposed on the layer so formed. A second layer of polymeric material is then applied over the first layer and the reinforcing element disposed thereon, the mask being subsequently removed to allow the reinforced artificial fingernail to be shaped in a conventional manner such as by means of a nail file.

14 Claims, 7 Drawing Figures

REINFORCED ARTIFICIAL FINGERNAIL

BACKGROUND AND SUMMARY OF THE INVENTION

Ornamental nail decoration is a practice which likely predates recorded history. More recent contributions to the art include the fabrication of artificial nails formed of metal, layers of polish, and the like. As an example of artificial nail articles disclosed by prior U.S. patents, Lewis, in U.S. Pat. No. 2,607,356, discloses a multi-layered artificial nail comprised of a flexible fabric secured on one side thereof to a human digital nail, the opposite side of the fabric having an ornamental film layer secured thereto. While the prior art is replete with examples of artificial nail structures securable to a human digital nail for aesthetic purposes, there exists a need for an artificial nail which can be formed to the particular contours and dimensions of the wearer of such a nail and which is reinforced to prevent damage to the artificial nail. Accordingly, the present invention provides a method for forming a reinforced artificial nail, particularly a fingernail, directly onto the nail of the individual intended to wear such nail, the invention further comprising the article of manufacture thereby formed.

The present method relates to the formation of a reinforced artificial nail, particularly a fingernail, on the nail of the individual intended to wear the present artificial nail. In particular, the present method comprises the disposition of a mask over the digit bearing the natural nail on which the present artificial nail is to be formed. A layer of a polymeric material, preferably an acrylic polymer, is applied in fluent form to the surfaces of the natural nail and onto surfaces of the mask, the fluent polymeric material being allowed to at least partially set. A reinforcing element, such as a rigid pin or cloth-like sheet of "glass" fibers or other similar material, is then disposed on the layer so formed. A second layer of fluent polymeric material is then applied over the first layer and the reinforcing element disposed thereon, the mask being subsequently removed on solidification of the layers of polymeric material to allow the reinforced artificial nail so formed, which nail adheres to the natural nail surmounted thereby, to be shaped in a conventional manner such as by means of a nail file.

Accordingly, it is an object of the present invention to provide a method for forming a reinforced artificial nail on a natural human digital nail to increase the apparent length and aesthetic appearance thereof.

It is another object of the invention to provide a reinforced artificial nail directly formable on a natural human digital nail and formed of at least two layers of a polymeric material having a reinforcing element disposed therebetween.

It is a further object of the present invention to provide a reinforced artificial nail having a reinforcing element comprised of a rigid pin longitudinally and centrally disposed within said artificial nail.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
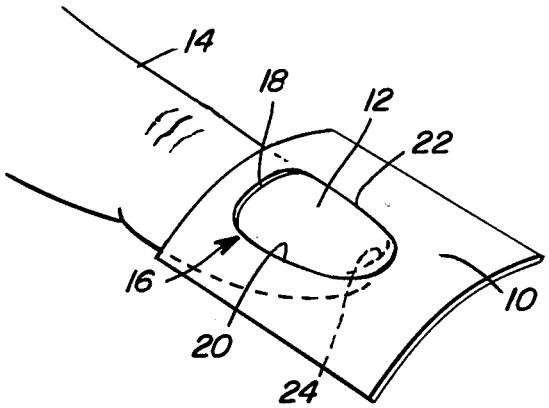
FIG. 1 is a perspective view illustrating the first step in the present method, said first step comprising the masking of the natural nail onto which the present reinforced artificial nail is to be formed.

Referring now to the drawings and particularly to FIG. 1, the present method can be seen to be illustrated by the formation on a natural fingernail of a reinforced artificial nail according to the invention. As seen in FIG. 1, the first step of the present method can be seen to comprise the disposition of a mask 10 over a natural fingernail 12 on finger 14. The mask 10 has a transverse arcuate contour, the mask further having an opening 16 disposed therein into which the natural fingernail 12 is received. The opening 16 is seen to be generally formed in the shape of a natural fingernail, rear edge portion 18 of the opening essentially following the contour of the rear edge of the natural fingernail 12 while side edge portions 20 and 22 of the opening 16 follow the contour of the side edges of the natural fingernail 12. The rear edge portion 18 and the side edge portions 20 and 22 are seen to be disposed in surmounting relation to the edges of the fingernail 12 subtended by said edge portions. Frontal edge portion 24 of the opening 16 is seen to be substantially arcuate and to fit under the distal edge of the fingernail 12. Accordingly, it can be readily seen that mask 10 be provided with a plurality of openings 16 of differing sizes to conform to differing sizes of natural fingernails.

With the natural fingernail 12 so masked, a layer 26 of polymeric material, preferably an acrylic polymer as will be described hereinafter, is applied directly to the upper surface of the fingernail 12, the mask 10 preventing application of the polymeric material to the skin surfaces of the finger 14. As can further be seen in FIG. 2, surface portions 28 adjacent to and forward of the frontal edge portion 24 of the mask 10 also has forward portions of the layer 26 disposed thereon to a distance slightly greater than the length of the artificial fingernail which is to be formed on said fingernail 12. Extraneous portions of the artificial fingernail can be readily trimmed away after formation thereof to a desired size.

Figure 3:
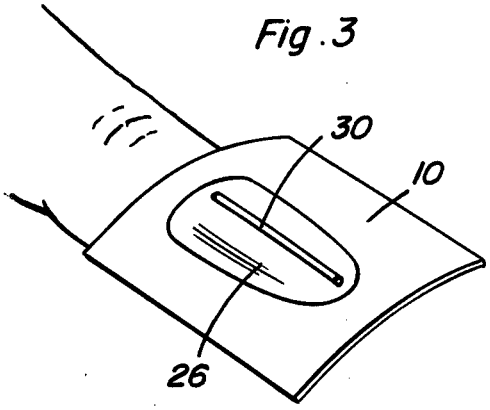
FIG. 3 is a perspective view illustrating the step of disposing a reinforcing element, particularly a rigid pin, onto the layer formed in FIG. 2.
Figure 4:
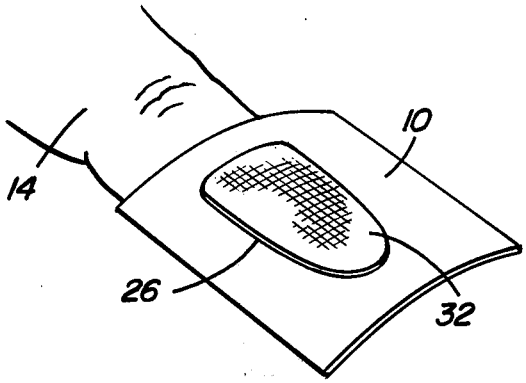
FIG. 4 is a perspective view illustrating the disposition of a cloth-like sheet of reinforcing material over the layer formed in FIG. 2, the step so illustrated representing a second embodiment of the invention.

The layer 26 can be allowed to at least partially solidify prior to the disposition of a reinforcing element such as is seen in FIG. 3 or FIG. 4 onto the surface of said layer 26. As particularly seen in FIG. 3, a pin 30 of elongated conformation is seen to be disposed on the layer 26 and oriented substantially longitudinally of the fingernail 12. The pin 30 is preferably formed of a material such as aluminum or other material which is relatively rigid but is sufficiently flexible to be bent into an arcuate curvature to match the longitudinal curvature of the layer 26 which conforms to the curvature of the natural fingernail 12. The material selected for formation of the pin 30 must also be capable of retaining this arcuate contour.

As seen in FIG. 4, the reinforcing element used to form the reinforced artificial fingernail of the invention can alternatively comprise a sheet 32 of reinforced material, the sheet 32 being preferably formed of a woven or pressed cloth-like fiber material such as can be formed of glass fibers, acrylic fibers, polyester fibers, metal strands, or other suitable reinforcing material.

Figure 2:
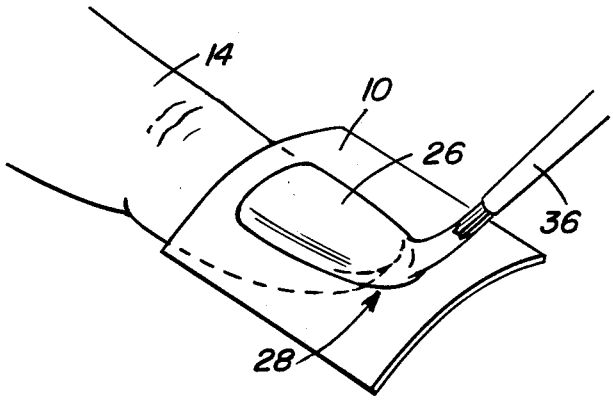
FIG. 2 is a perspective view illustrating the second step in the method of the present invention, said second step comprising the application of a layer of solidifiable polymeric material to the natural nail and to portions of the mask applied as shown in FIG. 1.
Figure 5:
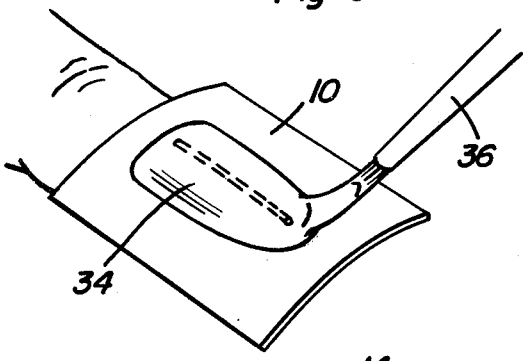
FIG. 5 is a perspective view illustrating the step of applying a solidifiable material over the structure shown in FIG. 3.

As seen in FIG. 5, the layer 26 having a reinforcing element disposed thereon, FIG. 5 showing the pin 30 as the reinforcing element, has a second layer 34 of polymeric material applied thereto. As can be seen in FIGS. 2 and 5, the layers 26 and 34 of polymeric material can be applied by any convenient means such as a brush 36, the layer 34 being substantially coincident with the layer 26. On at least partial solidification of the layers 26 and 34, the mask 10 is removed from the finger 14, the mask 10 conveniently being removed by a forward and slightly upward movement relative to the finger. However, it is preferable to allow the layers 26 and 34 to completely solidify or polymerize so that no portions of said layers are deformed by removal of the mask 10.

Figure 6:
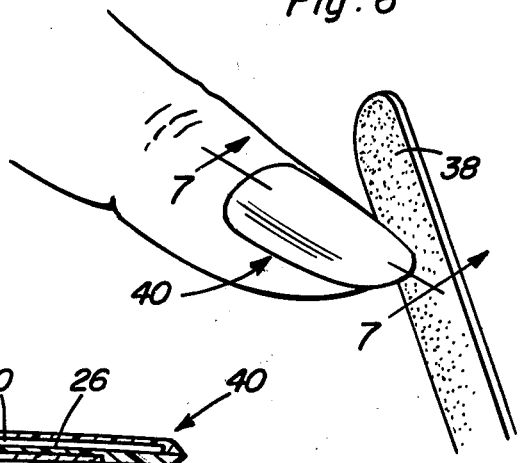
FIG. 6 is a perspective view illustrating the shaping of the present reinforced artificial fingernail.
Figure 7:
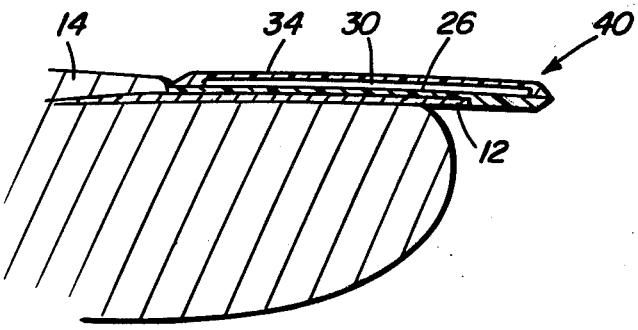
FIG. 7 is an idealized section taken generally along line 7—7 of FIG. 6.

After removal of the mask 10, the reinforced artificial fingernail of the invention, as seen at 40 in FIG. 6, can be readily shaped to a desired size and perimetric contour by means of conventional shaping instruments such as a file 38. As seen in FIG. 7, the reinforced artificial fingernail of the invention is seen to comprise the layers 26 and 34, said layers having the pin 30 (or sheet 32) disposed therebetween. At the respective ends and along the sides of the pin 30, the layers 26 and 34 are seen to be contiguous. If the layer 34 is applied to the layer 26 prior to complete solidification of said layer 26, the layers 26 and 34 flow together to some degree to provide additional adhesion therebetween. The thickness of the reinforced artificial fingernail 40 is typically the thickness of the natural fingernail 12, said artificial fingernail 40 being formable with a slightly greater thickness for additional strength or to allow additional shaping thereof.

The polymeric material of which the layers 26 and 34 are formed can comprise either thermoplastic or thermosetting polymers or copolymers such as can be formed of acrylic resin, polyester resin, or the like. Polymeric materials capable of forming a hard layer having high shock resistance are suitable to the present application. It has been found that acrylic resin is particularly useful in the practice of the invention, acrylic resin being a thermoplastic polymer or copolymer of acrylic acid, methacrylic acid, esters of such acids, or acrylonitrile. The monomers of this acrylic polymer polymerize readily in the presence of light, heat, or appropriate catalyst. The acrylic monomers can be converted into thermosetting resins, that is, in the form of cross-linked polymers, by adding acrylic anhydride, acrylamide, or glycol esters of acrylic acid to the monomers. It is to be understood that the invention is not to be limited to the use of acrylic resins, polyester resin also being a material suited to the formation of the reinforced artificial fingernail 40. Polyester resins comprise a group of thermosetting synthetic resins which are polycondensation products of dicarboxylic acids with dihydroxy alcohols. The polyester resins have the ability, when catalyzed, to cure or harden at room temperature. It is further to be understood that the sheet 32 of reinforced material can comprise acrylic fiber, modacrylic fiber, polyester fiber, or similar material having high strength-to-density, that is, high tensile strength, along the longitudinal axis of the fibers.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method for forming a reinforced artificial nail on a natural digital nail, comprising the steps of:
   disposing a mask on the digit on which the natural digital nail is carried to expose upper surface portions of the natural digital nail through an opening in the mask;
   applying a first continuous layer of hardenable polymeric material to the exposed upper surface portions of the natural digital nail, and to at least portions of adjacent upper surface portions of the mask to extend the apparent length of the artificial nail beyond the length of the natural digital nail;
   disposing a reinforcing element on at least portions of the upper surface of the first layer of polymeric material;
   applying a second continuous layer of hardenable polymeric material to the upper surface of the first layer and over the reinforcing element to enclose the reinforcing element between the first and second layers; and,
   removing the mask.

2. The method of claim 1 and further comprising the step of allowing the first and second layers to harden prior to removal of the mask.

3. The method of claim 1 and further comprising the steps of:
   allowing the first and second layers to harden; and,
   shaping the artificial nail.

4. The method of claim 1 wherein the step of disposing a reinforcing element comprises disposing an elongated pin member on at least portions of the upper surface of the first layer.

5. The method of claim 4 wherein the pin member is disposed on the first layer with the longitudinal axis of the pin member parallel to the longitudinal axis of the digit.

6. The method of claim 1 wherein the step of disposing a reinforcing element comprises disposing a sheet of fiber material on at least portions of the upper surfaces of the first layer.

7. The method of claim 1 wherein the step of disposing a mask comprises:
   aligning rear and side edge portions of the opening of the mask in substantially surmounting relation to rear and side edges of the natural digital nail; and,
   disposing a frontal edge portion of the opening of the mask under the distal end of the natural digital nail, the first continuous layer being applied to upper surface portions of the mask adjacent to the distal end of the natural digital nail.

8. The method of claim 1 wherein the first layer and the second layer comprise different polymeric materials.

9. The method of claim 1 wherein the first and second layers comprise acrylic polymer.

10. A reinforced artificial nail for extending and rendering more ornamental a natural digital nail, comprising:

a first layer of polymeric material adhered to the upper surface of the natural digital nail, and shaped substantially in the form thereof, at least portions of the first layer extending beyond perimetric portions of the natural nail;

a reinforcing element disposed on the first layer; and, a second layer of polymeric material disposed over and adhered to the upper surface of the first layer and the reinforcing element to enclose the reinforcing element between said first and second layers.

11. The artificial nail of claim 10 wherein the reinforcing element is a pin.

12. The artificial nail of claim 11 wherein the pin is disposed with the longitudinal axis thereof substantially parallel to the longitudinal axis of the digit and the pin is arcuately bent to conform to the curvature of the natural nail.

13. The artificial nail of claim 10 wherein the reinforcing element is a sheet of fiber material.

14. A reinforced artificial nail for extending and rendering more ornamental a natural digital nail, comprising:

a body of polymeric material shaped substantially in the form of a natural digital nail and having a portion thereof adhered to the upper surface of the natural digital nail, at least portions of the body extending beyond perimetric portions of the natural nail; and, a reinforcing element disposed within the body.

* * * * *